US006475080B1

(12) United States Patent
Rothney

(10) Patent No.: US 6,475,080 B1
(45) Date of Patent: Nov. 5, 2002

(54) FUME VENTILATION APPARATUS

(75) Inventor: Marc T. Rothney, Boulder, CO (US)

(73) Assignee: Roche Colorado Corporation, Boulder, CO (US)

( * ) Notice: Subject to any disclaimer, the term of this patent is extended or adjusted under 35 U.S.C. 154(b) by 0 days.

(21) Appl. No.: 09/669,058

(22) Filed: Sep. 22, 2000

Related U.S. Application Data

(60) Provisional application No. 60/172,014, filed on Dec. 23, 1999.

(51) Int. Cl.[7] ..... B08B 15/00
(52) U.S. Cl. ..... 454/370; 454/49
(58) Field of Search ..... 454/49, 63, 370; 141/65

(56) References Cited

U.S. PATENT DOCUMENTS 169,490 A * 11/1875 Smith
2,378,123 A * 6/1945 Beck
3,096,704 A * 7/1963 Russell
3,822,872 A * 7/1974 Nell
4,961,442 A * 10/1990 Crespin et al. ..... 454/49 X
6,171,407 B1 * 1/2001 Rackoski et al. ..... 454/49 X

* cited by examiner

*Primary Examiner*—Harold Joyce
(74) *Attorney, Agent, or Firm*—Townsend and Townsend and Crew LLP

(57) ABSTRACT

An apparatus for reducing the amount of fumes escaping into the surrounding atmosphere from an open container and from a chemical dispenser, and a method of use thereof comprising a bung slot ventilation apparatus and a chemical dispenser holder apparatus and a method of use thereof. The bung slot ventilation apparatus includes an inlet passageway comprising a fume exhaust port and a bunghole adapter, and a fume exhaust system adapter. And the chemical dispenser holder apparatus includes a holder comprising an inlet and a fume exhaust system adapter.

22 Claims, 5 Drawing Sheets

FUME VENTILATION APPARATUS

CROSS-REFERENCES TO RELATED APPLICATIONS

This application claims the benefit of U.S. Provisional Application No. 60/172,014, filed Dec. 23, 1999.

FIELD OF THE INVENTION

The present invention relates to an apparatus for reducing the amount of fumes escaping into the surrounding atmosphere from an open chemical container and from a chemical dispenser, and a method of use thereof.

BACKGROUND OF THE INVENTION

Many industrial processes generate fumes (e.g., vapors or gases) that are environmentally harmful—both to the surrounding physical plant and to the operating personnel. This is particularly true when a chemical container is left open or when transferring a chemical to and from a container.

Using a fume hood can reduce the amount of fumes released into the surrounding atmosphere. However a large fume hood is required when opening a large chemical container or dispensing or transferring a chemical to and/or from a large container, such as a drum. Moreover, using a large fume hood results in large amounts of air being constantly exhausted from the facility, even when there is no harmful fumes in the fume hood. These increased amounts of air exhaustion require larger ducting, scrubbing devices and fans. Having basically clean air being continuously exhausted also necessitates a larger air make-up unit to introduce fresh air to the facility to replenish the air being exhausted from the facility. Additional effluent is discharged to and must be treated by the waste treatment system. Higher electrical costs, higher maintenance costs and additional floor space are required to handle these larger systems that are removing air continuously from this additional fume hood which may be used or required only occasionally. Furthermore, this type of mitigation requires placing and removing the container to and from the fume hood, which may pose a problem especially when the container is large and/or heavy.

Therefore, there is a need to eliminate using a large fume hood during transfer of a chemical to and/or from a container, thus significantly decreasing the amount of air being exhausted from the facility on a continuous basis. There is a need for an inexpensive, reliable system which can be retrofitted to existing systems, for regulating the amount of air flow through an exhaust system without sacrificing safety in exhausting fumes from an open chemical container and a chemical dispenser. This reduction in exhausted air will result in a significant reduction in the overall sizing and cost of the ventilation system. This would save the user thousands of dollars on the original purchase of the equipment, and also significantly reduce the overall operating costs of ventilating the facility. Thus, there would be reduced power consumption, treatment costs, air make-up requirements, including heating and cooling of the facility, and overall maintenance for an improved system.

SUMMARY OF THE INVENTION

The present invention provides an apparatus for reducing the amount of fumes escaping into the surrounding atmosphere from an open chemical container and from a chemical dispenser, and a method of use thereof.

One aspect of the present invention provides a bung slot ventilation apparatus and a method of use thereof. The bung slot ventilation apparatus includes an inlet passageway comprising a fume exhaust port and a bunghole adapter, and a fume exhaust system adapter which is interconnected to the fume exhaust port. Preferably, the inlet passageway and the bunghole adapter are coaxial. In operation, the fume exhaust system adapter is interconnected to a fume exhaust system, preferably to an existing fume exhaust system. In one particular embodiment of the present invention, the bung slot ventilation apparatus is interconnected to a fume exhaust duct system. The bung slot ventilation apparatus can also include a fume conduit which provides a fluid communication between the fume exhaust system adapter and the fume exhaust system. Preferably, the fume conduit is a flexible member.

Another aspect of the present invention provides a chemical dispenser holder apparatus, which includes a holder comprising an inlet and a fume exhaust system adapter. Preferably, the holder is substantially an enclosed device having an inlet for inserting or placing a chemical dispenser. Preferably, the holder is attached to a support device. The chemical dispenser holder can also include a valve, preferably a ball valve, for opening and closing a fluid communication between the fume exhaust system and the chemical dispenser holder.

DETAILED DESCRIPTION

Figure 1:
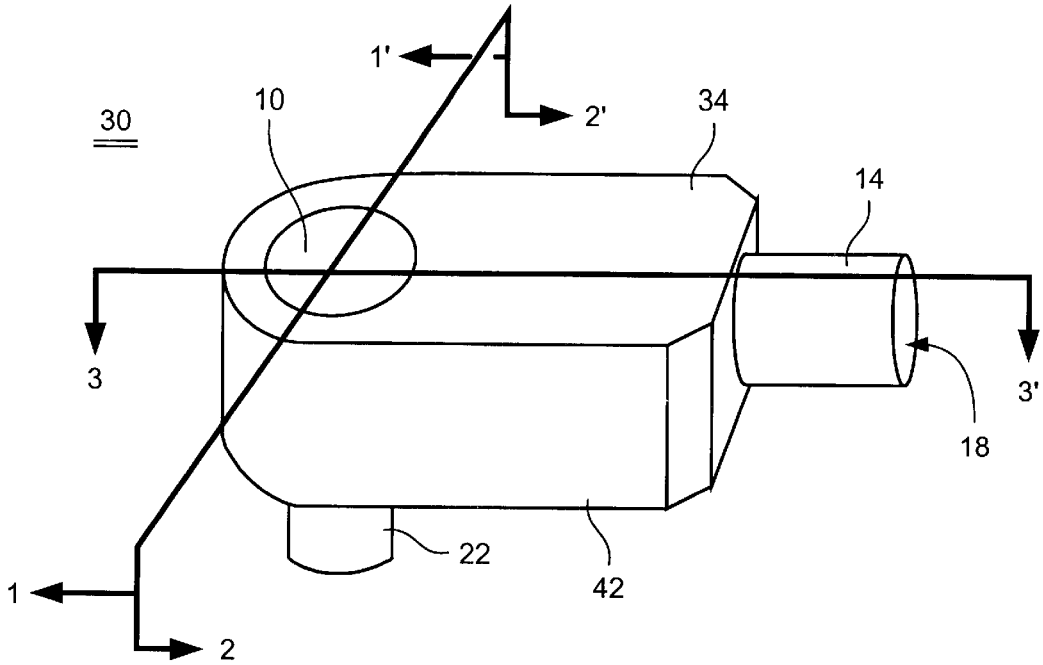
FIG. 1 is a perspective view of one embodiment of a bung slot ventilation apparatus of the present invention.
Figure 2:
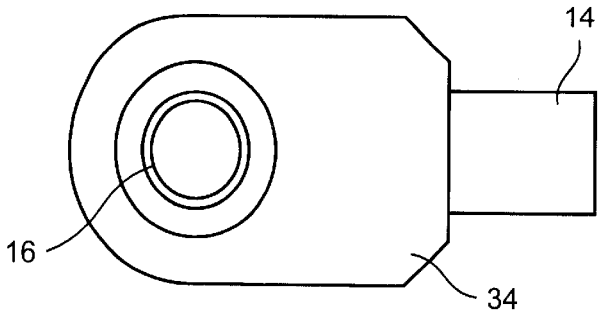
FIG. 2 is a top view of the bung slot ventilation apparatus of shown in FIG. 1.
Figure 3:
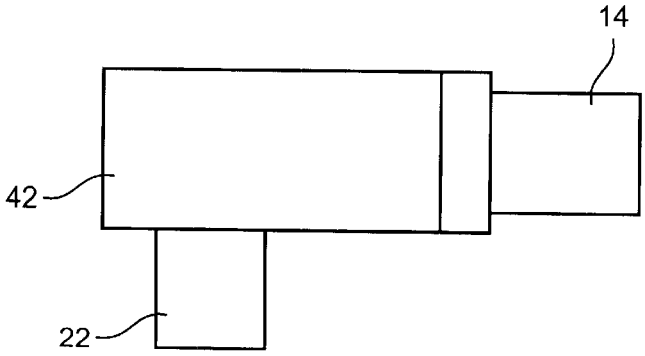
FIG. 3 is a side view of the bung slot ventilation apparatus shown in FIG. 1.
Figure 4:
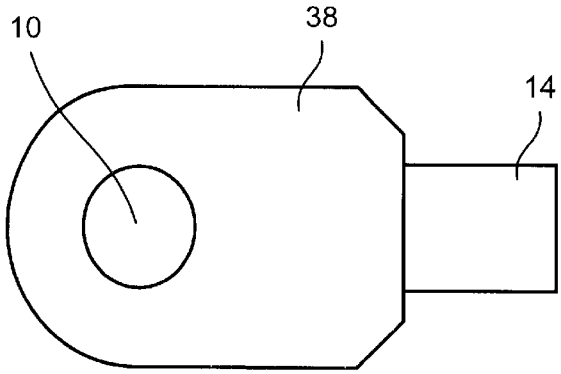
FIG. 4 is a bottom view of the bung slot ventilation apparatus shown in FIG. 1.
Figure 5:
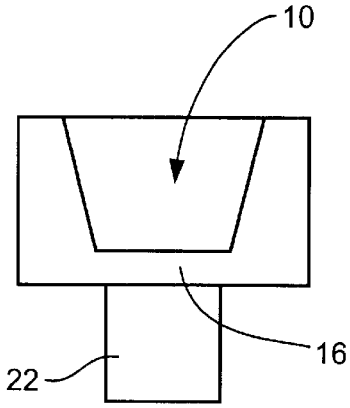
FIG. 5 is a cross-sectional view of the bung slot ventilation apparatus shown in FIG. 1 along the plane 1–1'.
Figure 6:
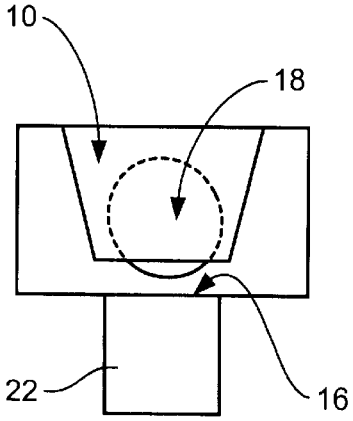
FIG. 6 is a cross-section view of the bung slot ventilation apparatus shown in FIG. 1 along the plane 2–2'.
Figure 7:
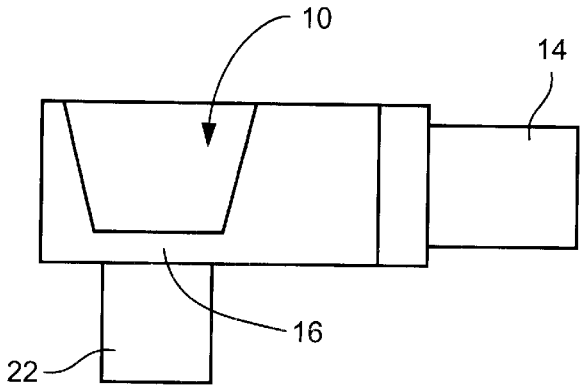
FIG. 7 is a cross-section view of the bung slot ventilation apparatus shown in FIG. 1 along the plane 3–3'.
Figure 8:
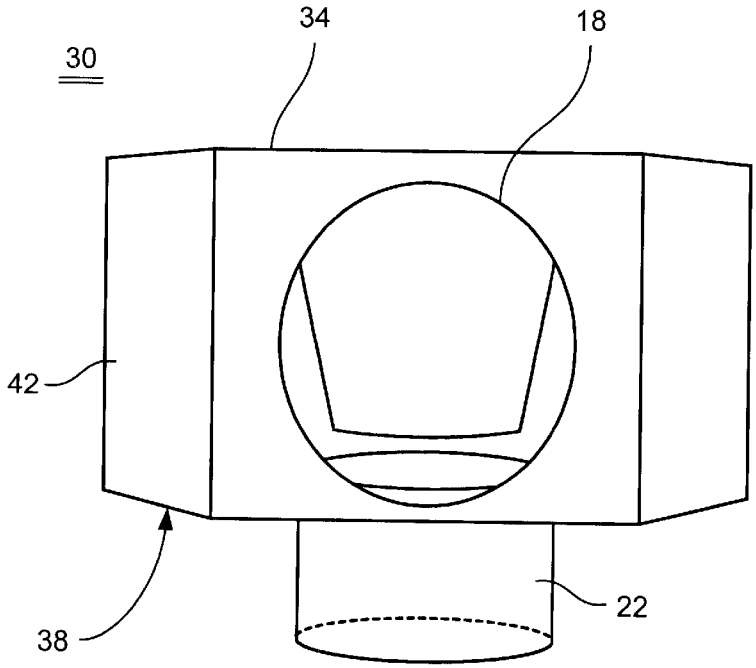
FIG. 8 is a view of the bung slot ventilation apparatus shown in FIG. 1 along the fume exhaust port.

The present invention will be described with regard to the accompanying drawings which assist in illustrating various features of the invention. In this regard, the present invention generally relates to an apparatus and a method for reducing fumes from escaping into the surrounding atmosphere from an open chemical container and from a chemical dispenser. In particular, the present invention relates to a bung slot ventilation apparatus, a chemical dispenser holder apparatus and a method of use thereof.

As used herein, the term "fume" refers to a gas, vapor, smoke or fine air-borne particles. Preferably, the fume is a vapor.

The term "surrounding atmosphere" refers to the area surrounding and in the vicinity of the exterior of a container or a chemical dispenser.

Illustrative embodiments of a bung slot ventilation apparatus and a chemical dispenser holder are generally illustrated in FIGS. 1–8 and FIGS. 9–10, respectively, which are provided for the purpose of illustrating the practice of the present invention and which do not constitute limitations on the scope thereof. It should be appreciated that while the bung slot ventilation apparatus of the present invention can be configured to be used with a variety of container sizes, for the purpose of illustration, unless otherwise stated the following descriptions are directed to an apparatus which is used with a large drum container, e.g., a conventional 55 gallon drum.

As shown in FIGS. 1–8, one embodiment of the present invention provides a bung slot ventilation apparatus for reducing the amount of fume escaping (i.e., released) from an open chemical container into the surrounding atmosphere. The bung slot ventilation apparatus includes an inlet passageway 10 and a fume exhaust system adapter 14. As used herein, the term "inlet passageway" refers to a portion of the bung slot ventilation apparatus which allows a chemical to be transferred to and from the container. The inlet passageway 10 includes a fume exhaust port 18 and a bunghole adapter 22. The fume exhaust system adapter 14 is interconnected to and is in fluid communication with the fume exhaust port 18.

Preferably, the inlet passageway 10 contains a fume exhaust slot 16 which is located on the entire circumference of the inlet passageway 10. In this manner, fumes are exhausted through the fume exhaust slot 16 and ultimately through the fume exhaust port 18. Without being bound by any theory, it is believed that having a fume exhaust slot 16 within the circumference of the inlet passageway 10 results in more efficient removal of fumes as this arrangement allows fumes to be removed not only from near the fume exhaust port 18 but also anywhere near the outer edge of the inlet passage way 10. The size of fume exhaust slot 16 is preferably smaller than the diameter of the fume exhaust port 18. At a given fume exhaust rate, the smaller the ratio of the fume exhaust slot 16 size relative to the diameter of fume exhaust port 18, the more "vacuum" (i.e., suction) power is created near the fume exhaust slot 16. Generally, the fume exhaust slot 16 provides at minimum capture flow velocity recommended in *Industrial Ventilation: A Manual of Recommended Practice* 23$^{rd}$ *Ed.*, American Conference of Governmental Industrial Hygienists, Cincinnati, Ohio, 1998, p.3–19. Thus, the fume exhaust slot 16 typically has an average minimum capture flow velocity in the range of from at least about 50 cubic feet per minute (cfm) to about 100 cfm.

The inlet passageway 10 is typically an orifice, a diameter of which depends on the size of the container inlet. While a large funnel shaped inlet passageway 10 aids in allowing ease of transferring a chemical to and from the container, this is not necessary when a chemical dispenser is used to transfer a chemical to or from the container, in which case a chemical dispenser is typically inserted into the inlet passageway 10 below the fume exhaust slot 16. It should be appreciated that while the chemical may be dispensed into the container above the fume exhaust slot 16, it is preferred that the chemical is dispensed below the fume exhaust slot 16 so that substantially all the fumes that are generated are not released into the surrounding atmosphere but are removed by the fume exhaust system (not shown). Preferably, that the inlet passageway 10 is coaxial to the bunghole adapter 22.

The fume exhaust slot 16 is an opening (e.g., a hole or slot) within the inlet passageway 10 which is interconnected to the fume exhaust port 18 and allows fumes to be exhausted through the fume exhaust system. The fume exhaust slot 16 may be a single large opening or it can comprise a plurality of openings located within the circumference of the inlet passageway 10. Preferably, the fume exhaust slot 16 forms a continuous complete loop around the interior circumference of the inlet passageway 10. The fume exhaust slot 16 can also include a screen or other similar devices (not shown) to prevent a solid material from entering the fume exhaust port 18.

The net air flow through the fume exhaust port 18 is designed to be sufficiently high enough to meet the guidelines set forth by the OSHA in limiting the amount of fumes released into the surrounding atmosphere. For use with a conventional 55 gallon drum, the inlet passageway 10 has an average diameter of about 1.5 inches. Alternatively, the fume exhaust port 16 has a minimum capture velocity flow rate of at least about 50 cfm, preferably at least about 55 cfm, and more preferably at least about 60 cfm.

Preferably, the bunghole adapter 22 forms a relatively tight fitting around the container's opening (not shown) to prevent a formation of a relatively large gap which may allow a substantial amount of fumes to be released into the surrounding atmosphere. The bunghole adapter 22 may be a conically-shaped (or cup-shaped) to fit down over or, preferably, into the container's opening. Or, depending on the container's opening, the bunghole adapter 22 may be threaded to allow direct coupling, e.g., a camlock-style coupling, to the container's opening. Still alternatively, the bunghole adapter 22 may include a threaded bushing (not shown), which also allows a camlock-style coupling.

The bunghole adapter 22 may be an integral part of the inlet passageway 10, or it can be removably interconnected to the inlet passageway 10 so that a different size bunghole adapter 22 can be fitted to the bung slot ventilation apparatus. This interchangeability of a different size bunghole adapter 22 allows the bung slot ventilation apparatus to be used with a variety of container opening sizes.

The fume exhaust system adapter 14 allows the bung slot ventilation apparatus to be connected to a fume exhaust system. This attachment may be permanent or temporary, such that it is removably attached. Preferably, the fume exhaust system adapter 14 is removably attached to the fume exhaust system, thereby making it portable. In this manner, one can use the portable bung slot ventilation apparatus at various locations in the facility. Typically, the bung slot ventilation apparatus of the present invention is interconnected to an existing fume exhaust duct system (not shown).

The connection between the fume exhaust system adapter 14 and the fume exhaust system can be achieved by using a fume conduit (not shown), which allows the bung slot ventilation apparatus to be removably connected to an existing fume exhaust duct system. The fume conduit can be a pipe, a tubing, a hose, or other similar devices. Preferably, the fume conduit is a flexible device, such as a flexible hose and a flexible tubing. In this manner, the bung slot ventilation apparatus can be used in a variety of different locations by easily attaching it to an existing fume exhaust duct system. This flexibility (e.g., portability) also eliminates a need for having to place the container in a specific area or location.

The bung slot ventilation apparatus can also include a body 30 comprising a top surface 34, a bottom surface 38 and a side surface 42. In one particular embodiment of the present invention, the bung hole adapter 22 is located on the bottom surface 38, and the inlet passageway 10, which contains the fume exhaust slot 16 interconnected to the fume exhaust port 18, is coaxial to the bunghole adapter 22. The bung slot ventilation apparatus of the present invention can also include a second fume exhaust port (not shown), which is located on the bottom surface 38. The second fume exhaust port is in a fluid communication with the fume exhaust system adapter 18 for reducing the amount of fumes which may be released through any gap that may be present between the container inlet and the bunghole adapter 22.

In one particular embodiment of the present invention, the bung slot ventilation apparatus for a 55 gallon drum comprises a body 30 having height of about 2½" with a bunghole adapter 22 (about 2" length (l)×about 2" inner diameter (i.d.)×about 1/16" thickness) that is coaxial to the inlet passageway 10, a fume exhaust slot 16 (about ¼" in height), a fume exhaust system adapter 14 (about 3" (l)×about 2" (i.d.)×about 1/16" in thickness) and a fume exhaust port 18 (about 2" (i.d.)×about 3" (l)×about 1/16" thickness) located within the inlet passageway 10.

The bung slot ventilation apparatus can be made from a variety of materials including metal, such as brass, copper, stainless steel, and the like; plastics such as polyvinyl chloride, and other relatively non-reactive polymers; and mixtures thereof. The bung slot ventilation apparatus (or any other devices described herein) can be fabricated or produced by any of the variety of apparatus fabrication methods known to one of ordinary skill in the art including injection molding of plastics. Because devices disclosed herein are used in dispensing organic solvents, most of which are flammable, it is preferred that the devices (e.g., the bung slot ventilation apparatus and the holder, which is described in detail below) comprise a means for preventing static electricity build-up. Such means include simply connecting the device to a grounding wire, especially if the device is made of metal such as stainless steel. If the device is made of plastic, one can incorporate carbon particles, which act as organic conductor to reduce or eliminate any static electricity build-up. Alternatively, metal wire(s) can be placed in or around the funnel which can be connected to a grounding wire.

The bung slot ventilation apparatus of the present invention can be used to fill or remove a chemical from a container, but generally it is used for removing chemicals from a container (e.g., drum). When removing a chemical from a container, the bung slot ventilation apparatus of the present invention is generally used in conjunction with a chemical dispenser (not shown), preferably a liquid chemical dispenser. A chemical dispenser is any device which allows transfer of a chemical from one container (e.g., drum) to another container (e.g., reaction vessel). Exemplary chemical dispensers include a nozzle, a chute, a tube, a pipe, a wand, a hose and other similar devices.

After transferring the chemical to a container, the chemical dispenser may contain a small amount of chemical within the chemical dispenser that is exposed to the surrounding atmosphere which may generate and release fumes (e.g.,a vapor) into the surrounding atmosphere. This is especially true when the chemical dispenser containing a volatile chemical is left exposed to the surrounding atmosphere for a prolonged period of time. To prevent release of fumes from the chemical dispenser into the surrounding atmosphere, the present invention also provides a chemical dispenser holder apparatus.

Figure 9:
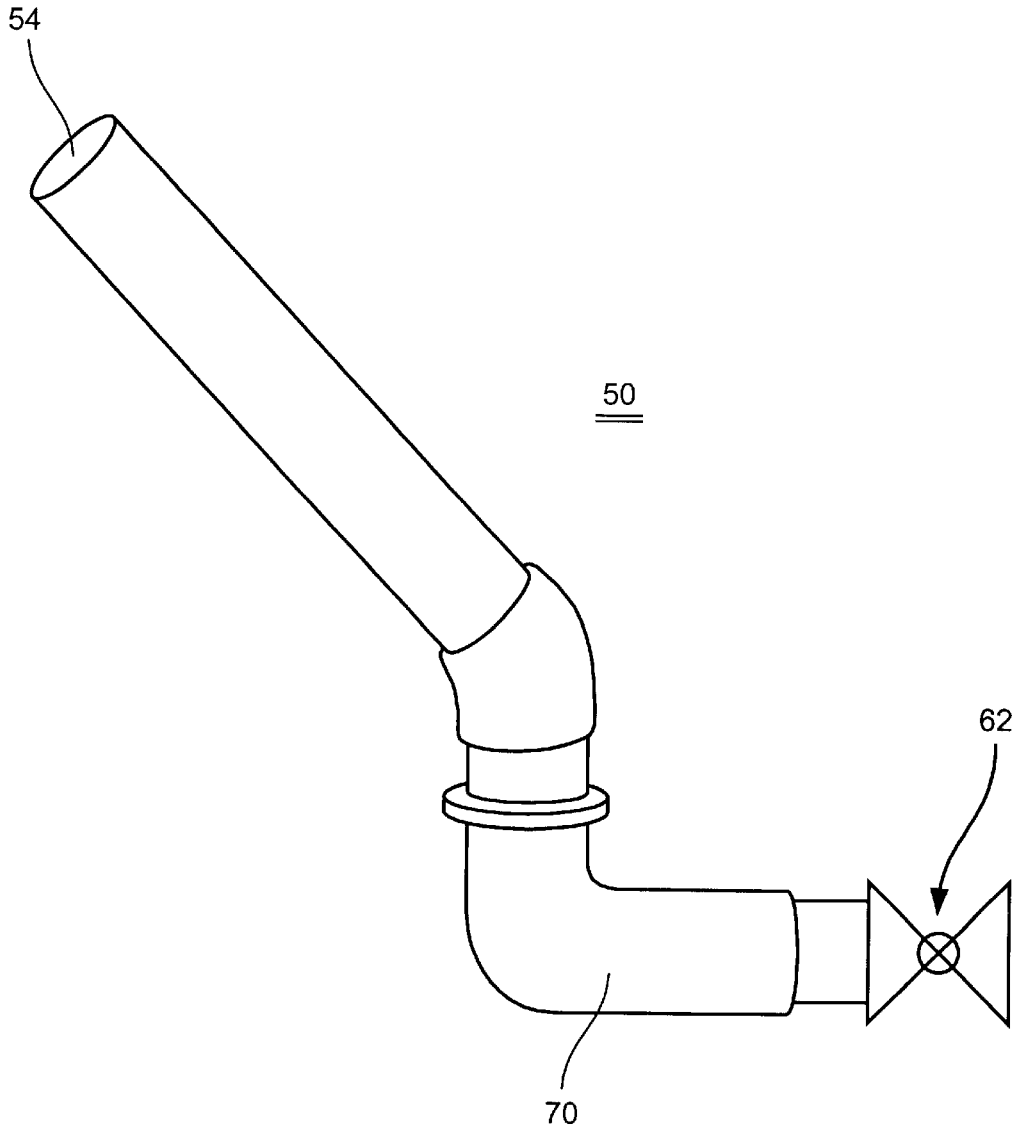
FIG. 9 shows a perspective view of one embodiment of a chemical dispenser holder of the present invention.
Figure 10:
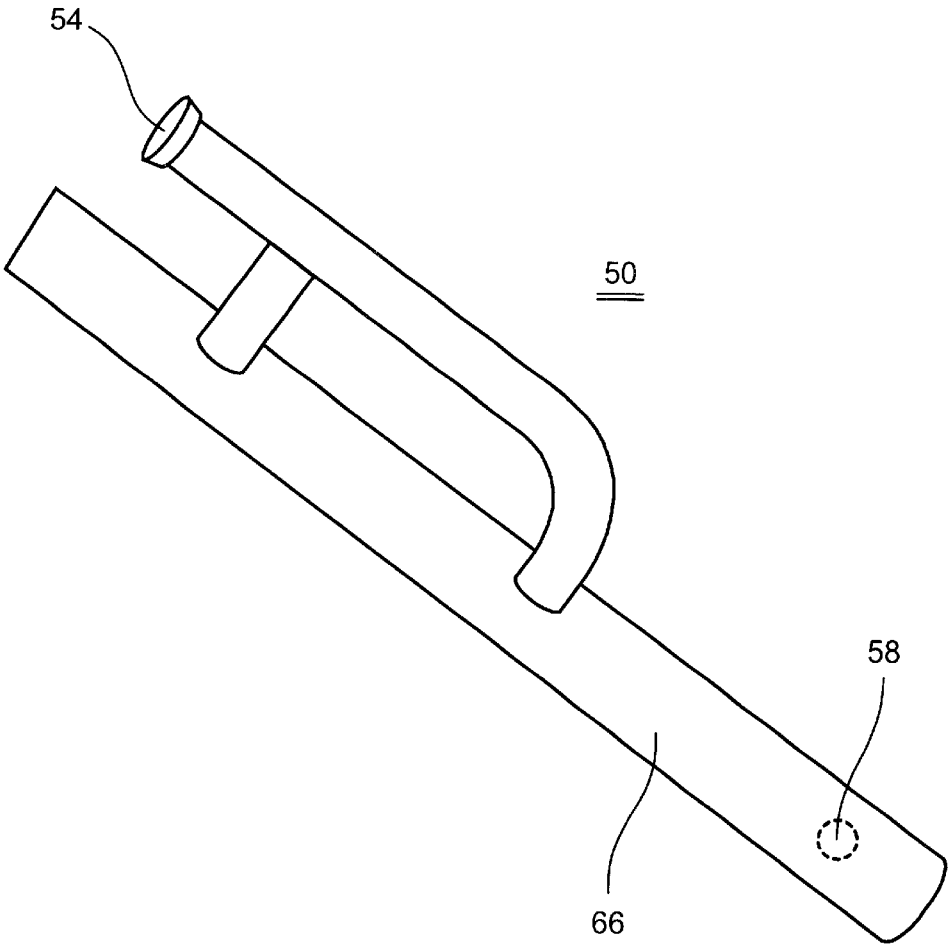
FIG. 10 shows a perspective view of another embodiment of a chemical dispenser holder of the present invention.

As shown in FIGS. 9 and 10, the chemical dispenser holder apparatus of the present invention includes a holder 50 having an inlet 54 in the proximal end for inserting (or placing) the chemical dispenser and a fume exhaust system adapter 58 for connecting the holder 50 to a fume exhaust system (not shown). The holder 50 is generally a substantially enclosed device having an orifice for inserting a chemical dispenser. The holder 50 can be any device which has an opening on one end for inserting the chemical dispenser and a fume exhaust system adapter 58 for connecting the holder 50 to a fume exhaust system. Exemplary holder devices include a tube, a pipe or other similar devices which are fitted with the fume exhaust system adapter 58.

The chemical dispenser holder apparatus can also include a valve 62, preferably a ball valve, or other similar devices interconnected to the fume exhaust system adapter 58 for opening and closing a fluid connection between the holder 50 and the fume exhaust system. Alternatively, the valve 62 can be located on the fume exhaust duct system. In this manner, the chemical dispenser holder apparatus can be turned-off, i.e., no fluid communication exists between the holder 50 and the fume exhaust system, to allow cleaning or servicing of the holder 50 and/or to prevent unnecessarily exhausting clean air.

Generally, the holder 50 is attached, preferably removably, to a support device (not shown) at an angle of at least about 20° from horizontal.

The chemical dispenser holder apparatus of the present invention can also include a reservoir section 66 in the distal end for capturing any liquid or a solid material which may inadvertently fall into the holder 50. This reservoir section 66 prevents the liquid or the solid from clogging or inhibiting the flow of fumes into the fume exhaust system. Generally, the reservoir section 66 refers to any enclosed volume of space in the holder 50 below the fume exhaust system adapter 58. The fume exhaust system adapter 58 can be located anywhere along the holder 50, including near the inlet 54 in the holder 50 where the chemical dispenser is inserted.

As will be appreciated, the length of the holder 50 and the orifice size of the inlet 54 depends on a particular size of the chemical dispenser used. Typically, the orifice size of the inlet 54 is sufficiently large enough such that a chemical dispenser can be placed easily without any difficulty, but the orifice size is sufficiently small enough to eliminate a need for an unnecessarily large amount of air flow. The length of the holder 50 is generally designed to be long enough to hold a chemical dispenser without having it fall out of the holder accidentally.

In one particular embodiment of the present invention, as shown in FIG. 9, the holder 50 is a threaded tubing (e.g., a 3" (i.d.) stainless steel or a polyvinyl chloride (PVC) tubing, or other similar material known to one of ordinary skill in the art), which is removably connected to an elbow joint 70 via a 3"×¾" bushing. The chemical dispenser holder apparatus is removably connected to a support device at an angle of about 45 degrees and to a fume exhaust system by a ¾" ball valve.

In another embodiment of the present invention, as shown in FIG. 10, the holder 50 comprises a first tubing (1½" (i.d.)×about 2½ feet to about 3½ feet (l)) having a 1½" (i.d.) ferrule at the inlet 54. The first tubing is interconnected to and has a fluid communication with a lower second tubing (3" (i.d.)×about 3 feet to about 4 feet (l)) which includes the fume exhaust system adapter 58 that is located proximal to the distal end. The chemical dispenser holder apparatus is removably mounted on a support device at an angle of about 30° and includes a ½" ball valve (not shown) for opening and closing a fluid communication between the chemical dispenser holder apparatus and a fume exhaust system.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and methods in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Legends for bung slot ventilation apparatus

10=inlet passageway

14=fume exhaust system adapter

16=fume exhaust slot

18=fume exhaust port

22=bunghole adapter

30=body

34=top surface

38=bottom surface

42=side surface

Legends for chemical dispenser holder apparatus

50=holder

54=inlet

58=fume exhaust system adapter

62=valve

66=reservoir section

70=elbow joint

What is claimed is:

1. An apparatus for reducing the amount of fumes escaping from an open container into the surrounding atmosphere comprising:

an inlet passageway comprising a fume exhaust slot and a bunghole adapter;

a fume exhaust port interconnected to said fume exhaust slot; and a fume exhaust system adapter interconnected to said fume exhaust port.

2. The apparatus of claim 1, wherein said fume exhaust slot is located within the entire circumference of said inlet passageway.

3. The apparatus of claim 1, wherein said fume exhaust system adapter is interconnected to a fume hood exhaust system.

4. The apparatus of claim 3, wherein said fume exhaust system adapter is removably interconnected to a fume hood exhaust system.

5. The apparatus of claim 3, further comprising a fume conduit, wherein one end of said fume conduit is connected to the fume hood exhaust system and the other end of said fume conduit is connected to said fume exhaust system adapter.

6. The apparatus of claim 5, wherein said fume conduit is a flexible hose.

7. The apparatus of claim 1, wherein said bunghole adapter is conically-shaped.

8. The apparatus of claim 1, wherein said bunghole adapter is threaded.

9. The apparatus of claim 1, wherein said bunghole adapter comprises a threaded bushing.

10. The apparatus of claim 1, wherein said inlet passageway and said bunghole adapter are coaxial.

11. An apparatus for reducing the amount of fumes released from an open container into the surrounding atmosphere comprising:

a body comprising an inlet passageway, a top surface, a bottom surface and a side surface, wherein said inlet passageway comprises a bunghole adapter, a fume exhaust slot and a fume exhaust port; and a fume exhaust system adapter interconnected to said fume exhaust port.

12. The apparatus of claim 11, wherein said fume exhaust slot is located within the entire circumference of said inlet passageway.

13. The apparatus of claim 11, wherein said fume exhaust system adapter is removably interconnected to a fume hood exhaust system.

14. The apparatus of claim 11, further comprising a fume conduit which is interconnected to a fume hood exhaust system and to said fume exhaust system adapter.

15. The apparatus of claim 14, wherein said fume conduit is a flexible hose.

16. The apparatus of claim 11, wherein said bunghole adapter is conically-shaped.

17. The apparatus of claim 11, wherein said bunghole adapter is threaded.

18. The apparatus of claim 11, wherein said bunghole adapter comprises a threaded bushing.

19. The apparatus of claim 11, wherein said inlet passageway and said bunghole adapter is coaxial.

20. The apparatus of claim 11, wherein said bunghole adapter is located on said bottom surface.

21. The apparatus of claim 11, wherein said fume exhaust system adapter is located on said side surface.

22. The apparatus of claim 11, further comprising a second fume exhaust port located on said bottom surface, wherein said second fume exhaust port is in a fluid communication with said fume exhaust system adapter.

* * * * *